US008783687B1

(12) United States Patent
Hoestje

(10) Patent No.: US 8,783,687 B1
(45) Date of Patent: Jul. 22, 2014

(54) THREE-DIMENSIONAL GAME DEVICES AND METHODS OF USE AND MANUFACTURE

(76) Inventor: Sara Hoestje, Lenexa, KS (US)

( * ) Notice: Subject to any disclaimer, the term of this patent is extended or adjusted under 35 U.S.C. 154(b) by 0 days.

(21) Appl. No.: 13/605,599

(22) Filed: Sep. 6, 2012

(51) Int. Cl.
*A63F 3/00* (2006.01)

(52) U.S. Cl.
USPC ..... 273/241; 273/287

(58) Field of Classification Search
USPC ..... 273/241, 287
See application file for complete search history.

(56) References Cited

U.S. PATENT DOCUMENTS 1,167,655 A * 1/1916 Passig ..... 273/120 R
3,184,237 A 5/1965 Riva
3,201,129 A * 8/1965 McFarland et al. ..... 273/241
3,481,606 A * 12/1969 Breslow et al. ..... 273/248
3,787,056 A * 1/1974 Hellmann ..... 273/251
4,081,183 A * 3/1978 Urban ..... 273/249
4,343,475 A * 8/1982 Stader ..... 273/276
5,169,153 A * 12/1992 Levy et al. ..... 273/241
6,554,280 B2 * 4/2003 Mazzola ..... 273/243
7,507,090 B2 3/2009 Herman
7,766,335 B1 * 8/2010 Greenawalt ..... 273/241
2009/0315259 A1 * 12/2009 Riley ..... 273/242

* cited by examiner

*Primary Examiner* — Vishu K. Mendiratta
(74) *Attorney, Agent, or Firm* — Lathrop & Gage LLP

(57) ABSTRACT

Three-dimensional game devices and methods of their use and manufacture are provided. One game device is disclosed for use with a plurality of game pieces and includes a three-dimensional pathway segmented into a plurality of distinct spaces in which the game pieces fit. The pathway rises and falls in elevation with at least one portion of the pathway passing over at least one other portion of the pathway such that the game pieces pass over the underlying portion and under the overlying portion when traveling along the pathway. The pathway is at least partially defined in a housing. An entrance portion of the pathway may be sloped downwardly and at least partially covered; and an exit portion of the pathway may be sloped downwardly, at least partially covered, and include an opening through which the game pieces pass to exit the pathway.

12 Claims, 8 Drawing Sheets

THREE-DIMENSIONAL GAME DEVICES AND METHODS OF USE AND MANUFACTURE

BACKGROUND

Game devices, and particularly board games, are very popular. Examples of prior art board games include Chutes And Ladders® and Candy Land™ both marketed by Hasbro, Inc. of Rhode Island. These and other such games typically use a two-dimensional playing surface having a path marked thereon and tokens or other game pieces for moving along the path to a finish line. The games are often distinguished by the indicia on the playing surface, the aesthetic configuration of the game pieces, and the method of selecting where game pieces are to be moved.

SUMMARY

Three-dimensional game devices and methods of their use and manufacture are disclosed. In one embodiment, a game device is provided for use with a plurality of game pieces. The game device includes a three-dimensional pathway segmented into a plurality of distinct spaces in which the game pieces fit. The pathway rises and falls in elevation with at least one portion of the pathway passing over at least one other portion of the pathway such that the game pieces pass over the underlying portion and under the overlying portion when traveling along the pathway. The pathway is at least partially defined in a housing.

In another embodiment, a game system includes a primary portion and an entry portion. The primary portion has a pathway segmented into a plurality of distinct spaces, and at least part of the pathway is recessed inside a housing. The entry portion has an opening, and a slide extends downwardly from the entry portion opening to the pathway in the primary portion. A plurality of game pieces are configured to pass through the entry portion opening, the slide, and the primary portion pathway; and at least one selection device is provided for determining advancement of the game pieces.

In still another embodiment, a method of playing a game includes the steps: (a) placing a game piece on a first slide and allowing the game piece to move along the first slide and come to rest at one of a plurality of spaces along a pathway; (b) moving the game piece along the pathway in accordance with guidance from at least one selection device; and (c) placing the game piece on a second slide and allowing the game piece to move along the second slide and exit the pathway through a covered opening.

DETAILED DESCRIPTION

Figure 1:
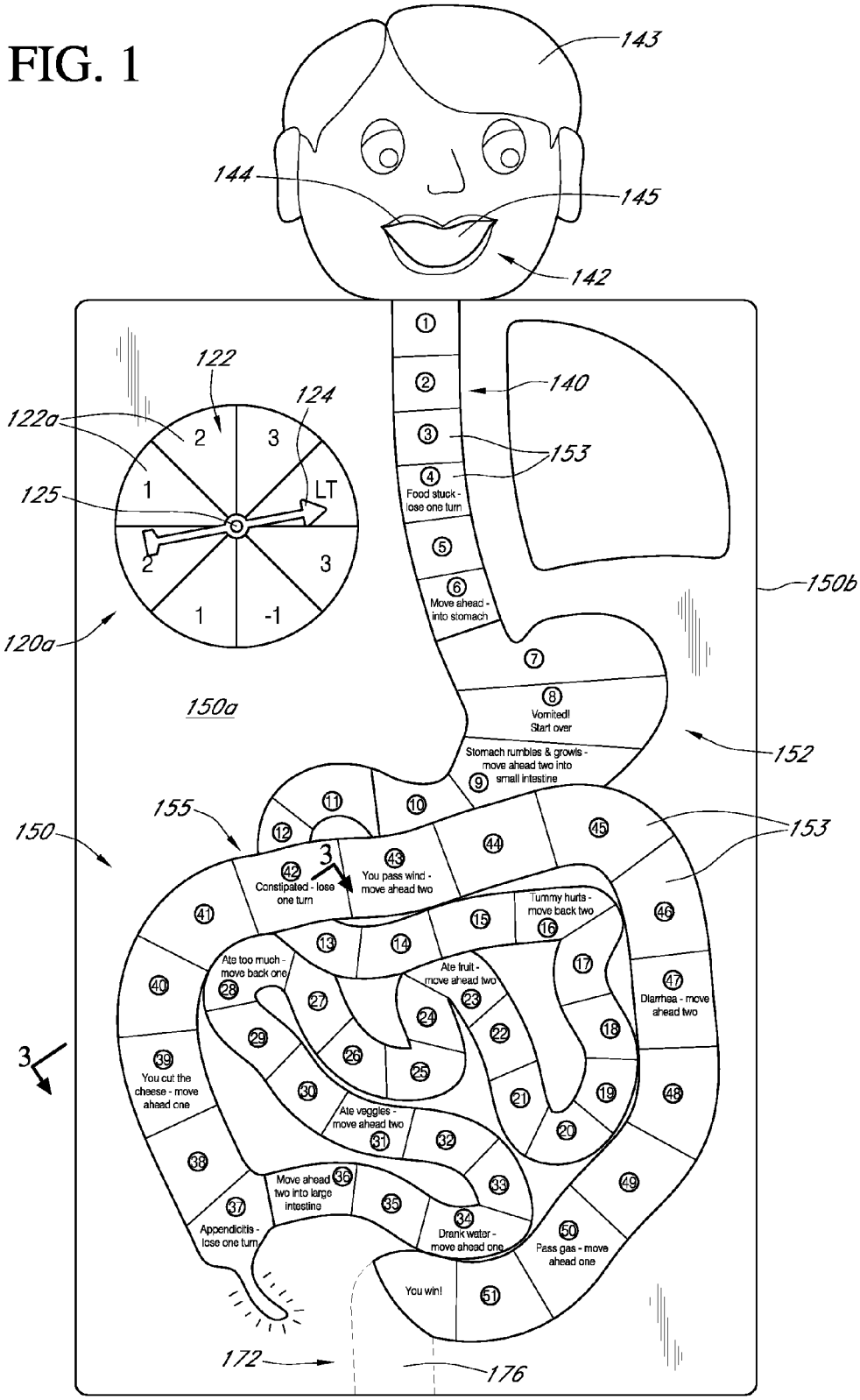
FIG. 1 shows a top view of portions of a three-dimensional game device according to one embodiment of the invention, at a use configuration.

FIGS. 1 through 7*c* illustrate three-dimensional game devices 100, according to various embodiments. One device 100 includes game pieces 110, a selection device 120, and a pathway 140. In some embodiments (such as shown), the game pieces 110 are selected to represent food items and the pathway 140 is configured to represent a human digestive system.

Figure 7A:
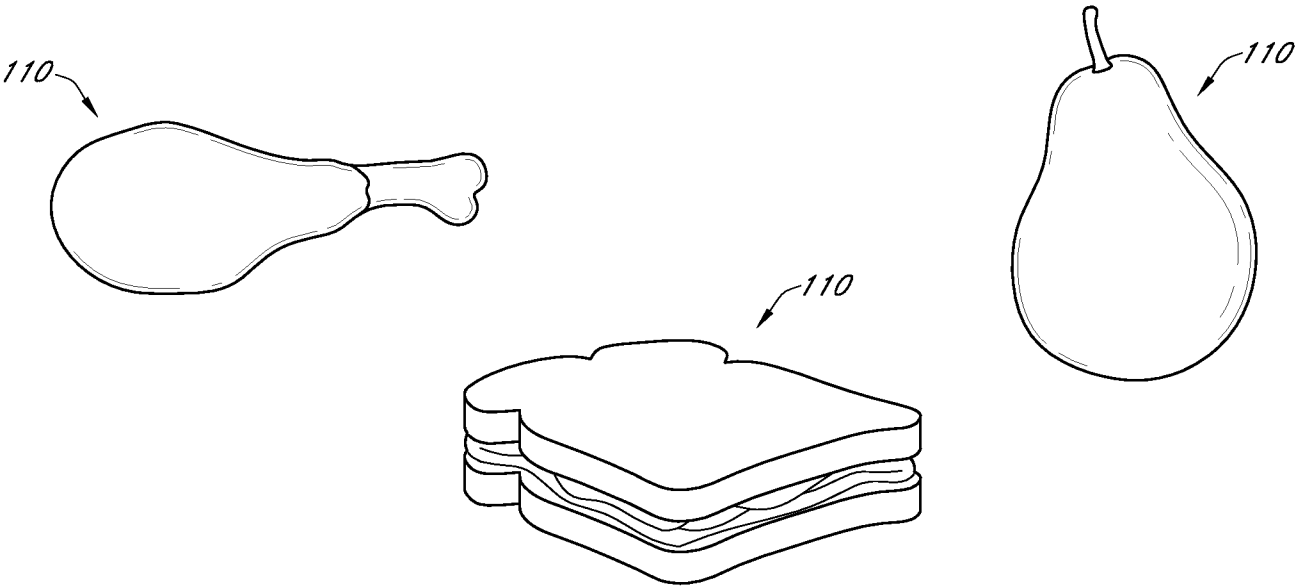
FIG. 7*a* shows a plurality of game pieces for use in the game device of FIG. 1.
Figure 7B:
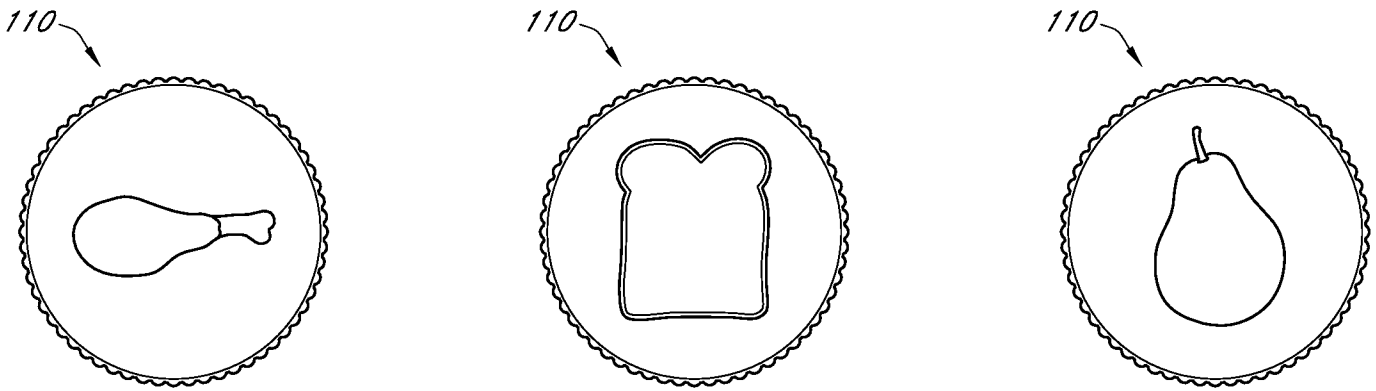
FIG. 7*b* shows another plurality of game pieces for use in the game device of FIG. 1.
Figure 7C:
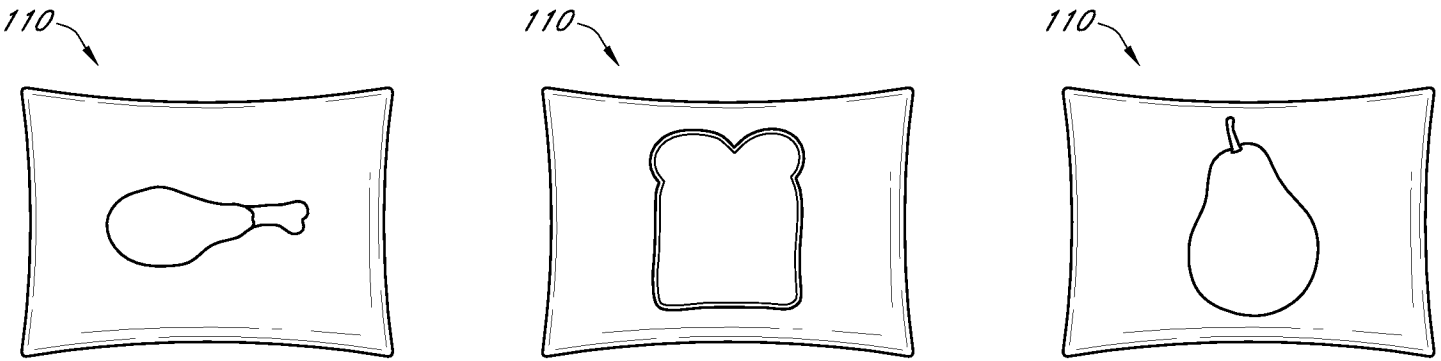
FIG. 7*c* shows yet another plurality of game pieces for use in the game device of FIG. 1.

Focusing first on the game pieces 110, the game pieces 110 may be configured in a variety of ways. In some embodiments, the game pieces 110 may be three-dimensional representations of items (e.g., three-dimensional representations of food, as shown in FIG. 7*a*). In other embodiments, as shown in FIG. 7*b*, the game pieces 110 may be tokens distinguished from one another by color, indicia (e.g., food indicia), and/or other identifying characteristics. And in still other embodiments, the game pieces 110 may be beanbag-type items (FIG. 7*c*) distinguished from one another by color, indicia (e.g., food indicia), and/or other identifying characteristics. Other types of game pieces 110 may also be appropriate (e.g., marbles or blocks having images of food thereon or visibly encased therein), though the game pieces 110 should be sized to fit throughout the pathway 140 as discussed below.

Figure 2:
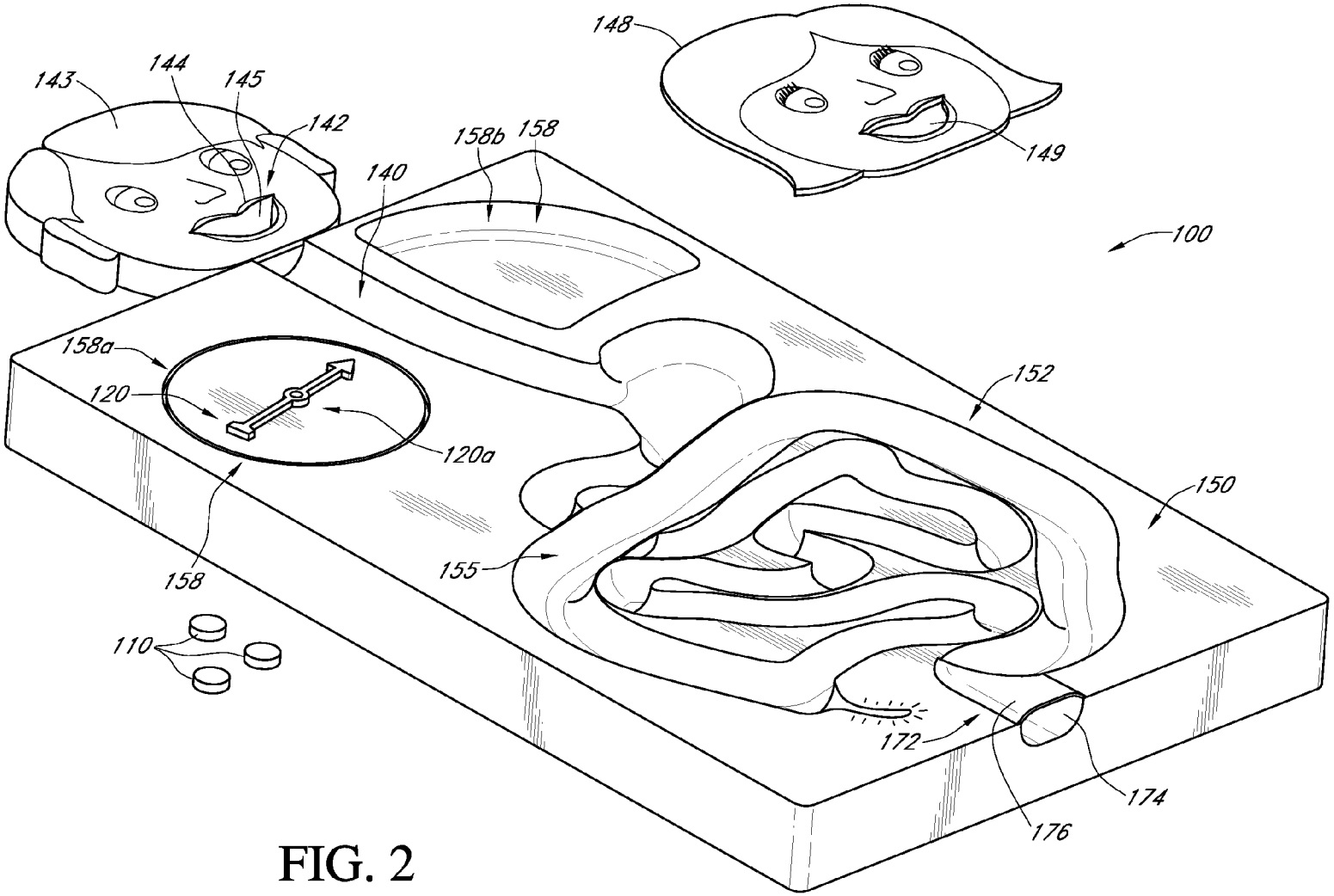
FIG. 2 shows a perspective view of the game device of FIG. 1, at the use configuration.

The selection device 120 is shown in FIGS. 1 and 2 to be a spinner 120*a*. The spinner 120*a* includes a field 122 of options 122*a* (FIG. 1) and an arrow 124 that rotates about an axis 125 to selectively point at one of the options 122*a*. Other appropriate selection devices 120 may include one or more die, a deck of cards, and/or any other selection device (whether now known or later developed). In some embodiments, the selection device may simply point a user to take a certain movement. In other embodiments, the selection device may include a further interactive component such as a question that must be correctly answered before the user may take the movement.

Attention is now directed to the pathway 140. The pathway 140 extends in three dimensions, with some portions passing directly above other portions. As noted above and as can be seen from the drawings, the pathway 140 in the embodiment 100 is configured to represent a human digestive system. While the pathway 140 may clearly be an abridged version of the human digestive system, it may nevertheless be desirable for each distinct part of the digestive system to be present in some manner, and it may further be desirable for the distinct parts to be generally proportional in some manner (e.g., diameter). In some embodiments, it may by particularly desirable for the distinct parts of the digestive system to be represented in a generally anatomically correct manner except for the length of the large and small intestines.

The pathway 140 of the embodiment 100 may be conceptually separated into three portions: an entrance portion 142, a primary portion 152, and an exit portion 172. The entrance portion 142 includes a representation of a human head 143 having an open mouth 144, and a downwardly-sloping tunnel 145 extends from the mouth 144 to the primary portion 152 of the pathway 140. The entrance portion 142 may be generally formed with (or fixedly coupled to) the primary portion 152, or (as shown in FIG. 1) it may be a separate piece that is temporarily positioned to form a unitary passage for the pathway 140. In some embodiments, at least one overlay 148 (FIG. 2) is provided that may be placed atop the head 143 to provide a different appearance. For example, overlays 148 may be provided to alter the race, gender, or age of the represented person. The overlays 148 may include an open mouth 149 that corresponds to the open mouth 144, allowing access to the tunnel 145 even when the overlay 148 is positioned atop the head 143.

The primary portion 152 of the pathway 140 is formed inside a housing 150 having an upper surface 150*a* (which may, but need not, be generally planar) and an external perimeter 150*b*, and at least part of the pathway 140 extends below the upper surface 150*a* such that the pathway 140 forms an uncovered tunnel. Different portions of the pathway 140 may be located at different relative heights inside the housing 150, causing the pathway 140 to raise and fall. Moreover, the pathway 140 may be segmented into distinct spaces 153 through indicia 154*a* (FIG. 4*a*), ridges 154*b* (FIG. 4*b*), a combination of indicia 154*a* and ridges 154*b*, or other acceptable divider. While each space 153 may be configured to hold at least one of the game pieces 110, the spaces 153 need not be all of the same shape or size. Different parts of the digestive system may also be highlighted through indicia. For example, the spaces 153 forming the esophagus, stomach, small intestines, and large intestines may have a distinct color or outline.

The housing 150 may be constructed in various manners. For example, the housing 150 may be vacuum formed, blow molded, stamped, or cast to define a hollow housing with a relatively thin but sturdy sidewall. While the housing 150 may alternately be formed in a manner that is generally not hollow, the additional material and weight added by such configurations may be undesirable. In some embodiments, the housing 150 may define cavities 158 (FIG. 2) separate from the pathway 140 for securing elements (e.g., game pieces 110, selection devices 120, etc.) when not in use. The cavities 158 may be either covered cavities, such as cavity 158*a*, or uncovered cavities, such as cavity 158*b*.

Figure 3:
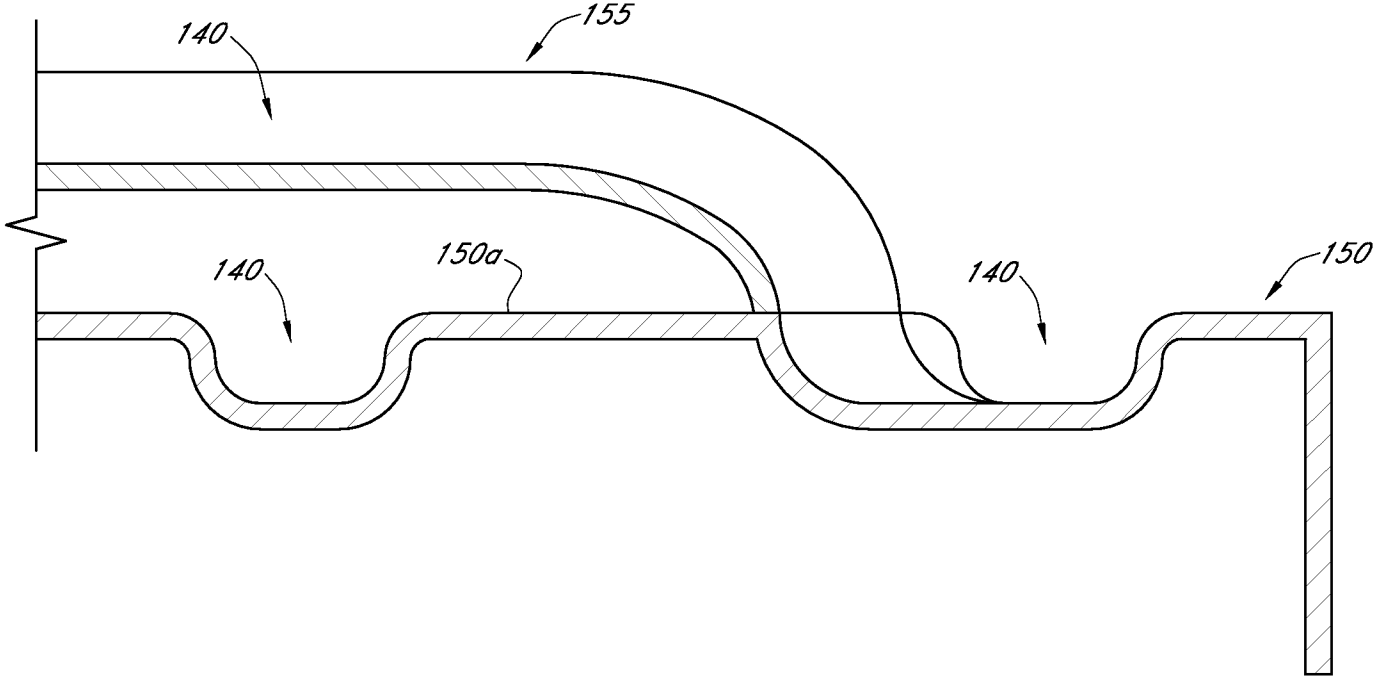
FIG. 3 shows a cross-sectional slice taken from section 3-3 marked in FIG. 1.
Figure 4A:
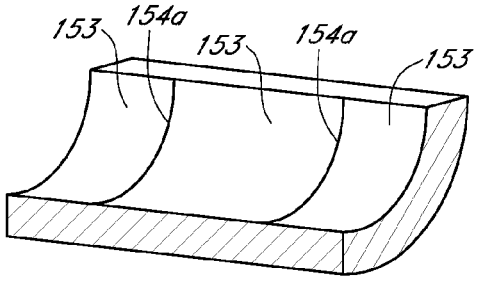
FIG. 4*a* shows a portion of a pathway of the game device of FIG. 1.
Figure 4B:
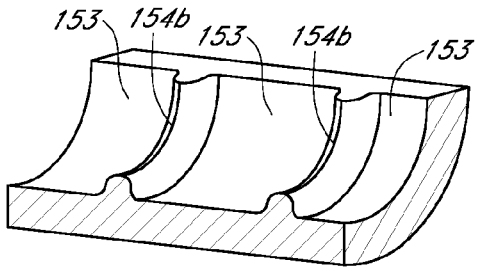
FIG. 4*b* shows a portion of a pathway of a game device according to another embodiment.
Figure 5:
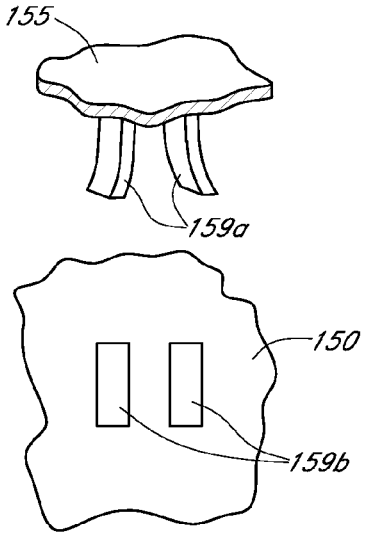
FIG. 5 shows a portion of the game device of FIG. 1.

As best shown in FIG. 3, some parts of the pathway 140 (e.g., upper portion 155) may extend above the housing upper surface 150*a* and other parts of the pathway 140, further conveying the three-dimensional and interweaving relationship of the illustrated digestive system. These upper portions 155 may be constructed separately from the housing 150, and may be fitted into place on the housing 150 either before being provided to the user or by the user after purchase. The upper portions 155 may be adhered to the housing 150, snapped to the housing 150, or coupled to the housing 150 in any other permanent or temporary manner, whether now know or later developed. FIG. 5 shows an example snapping configuration, with tabs 159*a* on the upper portion 155 configured for insertion in voids 159*b* in the housing 150.

Turning now to the exit portion 172 (FIG. 2), the exit portion 172 may include a covered pathway section 174 leading game pieces 110 out of the housing 150 to signify excretion of the processed food and that the digestive processes (as well as the game) are completed. Much like the upper portions 155 of the pathway 140, a covering 176 may be constructed separately from the housing 150 and subsequently coupled to the housing 150.

Figure 6:
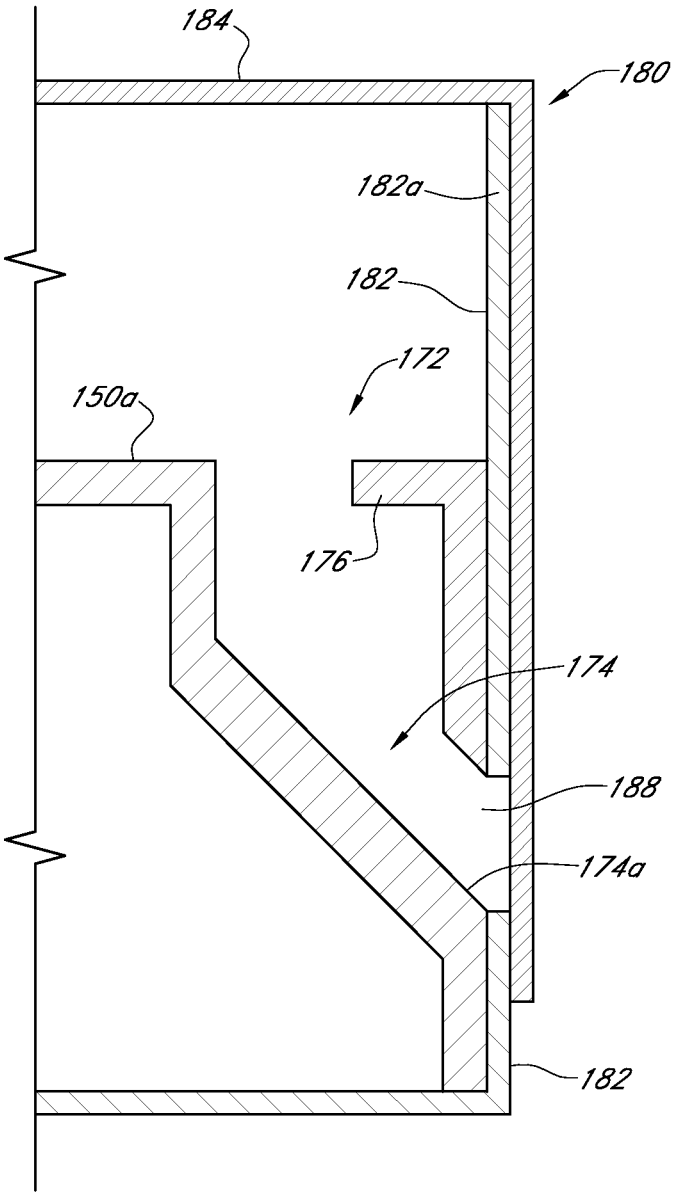
FIG. 6 shows a cross-sectional slice of an exit portion of the game device of FIG. 1, at a storage configuration.

In some embodiments, the housing 150 is contained in a box 180 (e.g., a cardboard box) having lower and upper portions 182, 184, as shown in FIG. 6. In such embodiments, it may be desirable for sidewalls 182*a* of the lower portion 182 to extend sufficiently high to prevent the upper portion 184 from resting on the pathway upper portions 155 when the box upper portion 184 is located atop the box lower portion 182. To allow the housing to be used without being removed from the box 180, a hole 188 in the box lower portion 182 may align with an end 174*a* of the covered pathway section 174, allowing game pieces 110 to pass through the exit portion 172 and out of the box 180 (when the box upper portion 184 is removed).

To use the three-dimensional game device 100, an overlay 148 (FIG. 2) is placed atop the head 143 if desired and at least two players each select a respective game piece 110. The first player places his game piece 110 through the mouth 144, and the game piece 110 slides through the downwardly-sloping tunnel 145 until it lands on a space 153 of the pathway 140. The second player then places his game piece 110 through the mouth 144, and that game piece 110 also slides through the downwardly-sloping tunnel 145 unit coming to a rest on a space 153. Under one set of rules, the game pieces may interact with one another, and may bump each other forwards or backwards; in such gameplay, the game pieces 110 of the first player may be moved forwards or backwards during the second player's turn, and the first player then resumes play from the new location.

After both players have begun by using the tunnel 145, the players alternately use the selection device 120 to determine how many spaces 153 to advance the game pieces 110. As shown in FIG. 1, the selection device 120 may allow the players to respectively advance (i.e., by obtaining a "1", "2", or "3"), may cause the players to respectively move backwards (i.e., by obtaining a "−1"), or may cause the players to respectively lose a turn (or, in other words, simply remain still, by obtaining a "LT"). The options for advancement shown in the embodiment 100 are in no way limiting.

As the game pieces 110 advance, the slope of the pathway 140 may cause the game pieces 110 to advance or retreat along the pathway 140 from one space 153 to another space 153, and the game pieces 110 will eventually pass below and above other portions of the pathway 140. In addition, indicia on the spaces 153 may cause the game pieces 110 to advance or retreat along the path 140, or to remain at a space 153 and miss a turn.

Once a game piece 110 reaches the exit portion 172, the game piece 110 passes downwardly through the covered pathway section 174 and out of the housing 110 (and the box 180, if the box 180 is present). The player whose game piece 110 passes out of the housing 110 first may be declared the winner. By passing along the three-dimensional path 140, the players may learn the portions of the digestive system and obtain an appreciation for the intertwined nature of the various parts, all while being enjoyably entertained.

After use, all elements may be located inside the box 180, and the box 180 may allow the game to be securely stored.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention. It will be understood that certain features and subcombinations are of utility and may be employed without reference to other features and subcombinations and are contemplated within the scope of the claims. The specific configurations and contours set forth in the accompanying drawings are illustrative and not limiting.

The invention claimed is:

1. A game device for use with a plurality of game pieces, the game device comprising:

a three-dimensional pathway segmented into a plurality of distinct spaces in which the game pieces fit; the pathway initiating at an entrance portion, continuing to a primary portion, and concluding at an exit portion; the pathway rising and falling in elevation with at least one part of the pathway passing over at least one other part of the pathway such that the game pieces pass over the underlying part and under the overlying part when traveling along the pathway; the pathway being at least partially defined in a housing; the entrance portion being sloped downwardly and at least partially covered; the exit portion being sloped downwardly and at least partially covered; the exit portion including an opening through which the game pieces pass to exit the pathway; and a box having lower and upper portions; the housing being positioned in the box lower portion; the box lower portion having an opening aligning with the exit portion opening for allowing the game pieces to pass therethrough; the box upper portion being selectively positioned atop the box lower portion to store the housing; the box upper portion sealing the box lower portion opening when the box upper portion is positioned atop the box lower portion.

2. The game device of claim 1, wherein indicia segments the pathway into the plurality of distinct spaces.

3. The game device of claim 1, further comprising a plurality of ridges segmenting the pathway into the plurality of distinct spaces.

4. A game device for use with a plurality of game pieces, the game device comprising:

a three-dimensional pathway segmented into a plurality of distinct spaces in which the game pieces fit; the pathway rising and falling in elevation with at least one portion of the pathway passing over at least one other portion of the pathway such that the game pieces pass over the underlying portion and under the overlying portion when traveling along the pathway; the pathway being at least partially defined in a housing; an entrance portion of the pathway being sloped downwardly and being at least partially covered; an exit portion of the pathway being sloped downwardly, being at least partially covered, and including an opening through which the game pieces pass to exit the pathway; the pathway being segmented into the plurality of distinct spaces by at least one item selected from the group consisting of ridges and indicia; and a box having lower and upper portions; the housing being positioned in the box lower portion; the box lower portion having an opening aligning with the exit portion opening for allowing the game pieces to pass therethrough; the box upper portion being selectively positioned atop the box lower portion to store the housing; the box upper portion sealing the box lower portion opening when the box upper portion is positioned atop the box lower portion.

5. The game device of claim 4, wherein the entrance portion of the pathway is removably coupled to another portion of the pathway.

6. A game system, comprising:

a pathway segmented into a plurality of distinct spaces; at least part of the pathway being recessed inside a housing; the pathway initiating at an entry portion and continuing to a primary portion; the entry portion being configured as a human head; the entry portion having an opening being configured as a human mouth; the primary portion pathway being configured as at least part of a digestive system;

a slide extending downwardly from the entry portion opening to the pathway in the primary portion;

a plurality of game pieces configured to pass through the entry portion opening, the slide, and the primary portion pathway; and at least one selection device for determining advancement of the game pieces.

7. The game system of claim 6, wherein a part of the primary portion pathway passes over another part of the primary portion pathway such that the game pieces pass over the underlying part and under the overlying part when passing through the primary portion pathway for illustrating the three-dimensional and interweaving relationship of the digestive system.

8. The game system of claim 6, further comprising an overlay configured for placement atop the entry portion to alter an appearance of the entry portion, the overlay having an opening configured to align with the entry portion opening.

9. The game device of claim 6, further comprising a plurality of ridges segmenting the pathway into the plurality of distinct spaces.

10. The game device of claim 6, further comprising a slide extending downwardly from the pathway in the primary portion to a covered exit.

11. The game device of claim 6, wherein the housing has an upper surface, and wherein an upper portion of the pathway is coupled to the housing and extends above the housing upper surface.

12. The game system of claim 6, wherein a part of the primary portion pathway passes over another part of the primary portion pathway such that the game pieces pass over the underlying part and under the overlying part when passing through the primary portion pathway.

* * * * *